US007829161B2

(12) United States Patent
Wexler et al.

(10) Patent No.: US 7,829,161 B2
(45) Date of Patent: Nov. 9, 2010

(54) FUSIBLE INKJET RECORDING ELEMENT AND RELATED METHODS OF COATING AND PRINTING

(75) Inventors: Allan Wexler, Pittsford, NY (US); David M. Teegarden, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 1027 days.

(21) Appl. No.: 11/374,360

(22) Filed: Mar. 13, 2006

(65) Prior Publication Data

US 2007/0211130 A1 Sep. 13, 2007

(51) Int. Cl.
*B41J 2/01* (2006.01)

(52) U.S. Cl. ..... 428/32.34; 347/105; 428/72

(58) Field of Classification Search ..... None
See application file for complete search history.

(56) References Cited

U.S. PATENT DOCUMENTS 6,723,397 B2 4/2004 Wexler
6,815,018 B2 * 11/2004 Wexler et al. ..... 428/32.25
2003/0165626 A1 9/2003 Poncelet et al.
2004/0115370 A1 6/2004 Funakoshi et al.
2004/0191433 A1 9/2004 Sakaguchi et al.

FOREIGN PATENT DOCUMENTS

JP 2001-180105 7/2001
JP 2004-216766 8/2004
JP 2004314475 A * 11/2004
WO 2004/069548 8/2004

* cited by examiner

*Primary Examiner*—D. Lawrence Tarazano
*Assistant Examiner*—Gregory Clark
(74) *Attorney, Agent, or Firm*—Chris P. Konkol; Andrew J. Anderson

(57) ABSTRACT

An inkjet recording element comprises a support having thereon at least one ink-receiving layer, including a porous fusible layer comprising fusible polymeric particles and a thermoresponsive polymer that is capable of exhibiting a lower critical solution temperature below 20° C.

20 Claims, 1 Drawing Sheet

FUSIBLE INKJET RECORDING ELEMENT AND RELATED METHODS OF COATING AND PRINTING

FIELD OF THE INVENTION

The present invention relates to a fusible inkjet recording element.

BACKGROUND OF THE INVENTION

In a typical inkjet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol, or mixtures thereof.

An inkjet recording element typically comprises a support having on at least one surface thereof at least one ink-receiving layer. The ink-receiving layer is typically either a porous layer that imbibes the ink via capillary action or a polymer layer that swells to absorb the ink. Swellable hydrophilic polymer layers tend to take a relatively longer time to dry compared to porous ink-receiving layers.

Porous ink-receiving layers are usually composed of inorganic or organic particles bonded together by a binder. The amount of particles in this type of coating is often far above the critical particle volume concentration (CPVC), which results in high porosity in the coating. During the inkjet printing process, ink droplets are rapidly absorbed into the coating through capillary action, and the image is dry-to-touch right after it comes out of the printer.

Inkjet prints, prepared by printing onto inkjet recording elements, are subject to environmental degradation. They are especially vulnerable to damage resulting from contact with water and atmospheric gases such as ozone. Ozone bleaches inkjet dyes resulting in loss of density. The damage resulting from post-imaging contact with water can take the form of water spots resulting from deglossing of the top coat, dye smearing due to unwanted dye diffusion, and even gross dissolution of the image recording layer. To overcome these deficiencies, inkjet prints can be laminated. However, lamination is expensive and adds complexity to printing, since a film laminate typically requires a separate roll of material, typically a film laminate in which an adhesive layer is prepared via an additional coating step. If the laminate is of the transfer type there is also added waste in the form of the exhausted coated support from which the film laminate is transferred.

Accordingly, efforts have been made to provide, in the form of a single sheet, an image-recording medium that has a top fusible layer which functions as a latent protective layer. This layer is porous and generally comprises fusible thermoplastic particles. This latent protective layer is often characterized as an ink-transporting layer when it is not retentive of the ink or colorant, which passes through to an underlying layer. When the layer functions as an ink-transporting layer, fusing transforms it into a protective topcoat for the underlying image. This single-sheet media design thereby eliminates the need for lamination to protect inkjet prints.

Absent a binder for the particles, the particles in the porous fusible layer may be heat sintered during the drying step to afford a continuous layer. Sintered layers, however, are relatively fragile and easily damaged. EP 858,905A1, for example, relates to an inkjet recording element having a porous, outermost layer formed by heat sintering thermoplastic particles of latex such as polyurethane which layer may contain a slight amount of a hydrophilic binder such as poly (vinyl alcohol). However, there is a problem with this inkjet recording element in that it has poor resistance to mechanical abrasion when it does not contain a hydrophilic binder, and poor water-resistance when it does contain a hydrophilic binder.

In other words, the use of typical water-soluble binders to improve prefusing durability of the porous fusible layer is disadvantaged in that, after fusing, the protective layer becomes susceptible to damage by water. Hydrophobic film forming binders, therefore, are preferred to make the layer more robust. U.S. Pat. No. 6,723,397 B2 (Wexler), for example, relates to an inkjet recording element in which a support has thereon in order in the direction from the support: (a) at least one porous, ink-retaining layer, and (b) a fusible, porous ink-transporting layer of fusible, polymeric particles and a film-forming, hydrophobic binder. The film-forming, hydrophobic binder can be any film-forming hydrophobic polymer capable of being dispersed in water, preferably an acrylic polymer or a polyurethane.

Polymers exhibiting a "lower-critical-solution-temperature," also referred to in the prior art as "thermosensitive polymers," "thermoresponsive polymers," "heat-responsive polymers," or the like, have been used in inkjet recording elements for various reasons. Thermosensitive polymers have been used to decrease the drying time of aqueous coating compositions that comprise hydrophilic polymers, since a thermosensitive polymer can be miscible with hydrophilic binders below its lower-critical-solution-temperature, but become hydrophobic and hence less water retentive when its temperature rises above its lower-critical-solution-temperature. Thermosensitive polymers have also been used to provide a smoother or glossier surface in inkjet recording elements that are not fusible. Finally, thermosensitive polymers have been used as a porogen, for the purpose of creating pores in a coated layer.

For example, US Patent Publication No. 2004/0191433 A1 (Sakaguchi et al.) relates to a recording medium having a porous ink-receptive layer comprising inorganic fine particles (hence, not fusible) and poly(vinyl alcohol) (hence, hydrophilic) as a main component of a binder. The ink-receptive layer further comprises a polymer emulsion containing a thermosensitive polymer which shows a hydrophilic property below the "thermosensitive temperature" and a hydrophobic property above the thermosensitive temperature. The coating solution is preferably maintained at a temperature not lower than the thermosensitive temperature until it is applied as a coating. When the coating solution is applied to a substrate, it is immediately cooled to a temperature not higher than the thermosensitive temperature. The publication states that by using a poly(vinyl alcohol) as a main component of a binder, and using a thermosensitive polymer emulsion in combination, the coating solution strongly thickens when it is cooled to a temperature not higher than the thermosensitive polymer emulsion and a void structure can be maintained when it is dried at relatively potent drying conditions. An inkjet recording element having high glossiness and ink-absorption property with high productivity is thereby obtained.

Patent application publication JP 2004-216766 similarly describes a coating composition comprising a polymer compound that is water-soluble at temperatures below its lower critical solution temperature (LCST) and hydrophobic above its LCST used in combination with poly(vinyl alcohol).

Both of the aforementioned compositions comprising poly (vinyl alcohol) are unsuitable for a fusible protective layer for reasons already described.

US Patent Publication No. 2004/0115370 (Funakoshi et al.) discloses a coating composition for manufacturing an inkjet recording element that comprises a polymer emulsion containing a thermosensitive polymer. The coating composition further comprises organic or inorganic fine particles, preferably made from a metal oxide, preferably not larger than one micrometer. The manufacturing method for the inkjet recording element comprises coating the coating composition on a substrate at a temperature above the thermosensitive temperature (or point) and then cooling down to a temperature not higher than the thermosensitive point. Thus, Funakoshi et al. state that the coating liquid is preferably prepared and used at a temperature above the temperature sensitive point (paragraph 0101). Funakoshi et al. further state that the coating liquid has a relative low viscosity at temperatures above the thermosensitive point, but abruptly becomes thick (or forms a gel) when the coating liquid is cooled down to a temperature not higher than the thermosensitive point. This is said to produce a very smooth and homogeneous coating layer with a good surface state that can be retained even after a drying process. As shown in Table 1 of US Patent Publication No. 2004/0115370, a water-soluble polymer such as poly(vinyl alcohol) is optional in the coating composition. It is noted that the inkjet recording element disclosed in this patent is not fused, so its surface state and gloss are as coated.

US Patent Publication No. 2003/0165626 (Poncelet et al.) relates to a method for preparing a coated material comprising a hydrophilic-based binder, in which the binder is cross-linked with a temperature-sensitive polymer that is water-soluble at temperatures below its lower critical solution temperature (LCST) and hydrophobic above its LCST. Such a method is unsuitable for a porous, fusible layer because of the substantial presence of a hydrophilic binder in the layer.

International Patent Publication WO 2004/069548 (Vaughan et al.) relates to a composition comprising a temperature-sensitive polyacrylamide and hydrophilic polymer particles and a method of coating the composition at a temperature below the LCST and then warming the material to a temperature above the LCST to form voids around the particulates in order to increase ink absorption. The layer disclosed is not a fusible protective layer and is intended to absorb the colorant in the ink.

JP2001-180105 A to Seiko Epson discloses a method of making an inkjet recording element in which the coating composition comprises, in an example, a thermosensitive polymer, silica gel, and poly(vinyl alcohol). The method involves applying the coating composition at a temperature below the thermosensitive point and then heating the substrate to a temperature above the thermosensitive point. The presence of the thermosensitive polymer in its hydrophobic state emits moisture and increases the efficiency of drying.

In view of the above, thermosensitive polymers have been used in the prior art for a variety of reasons, in a variety of inkjet recording elements, under various conditions, but not in fusible protective topcoats in inkjet recording elements for the purpose of stain and water-resistance.

OBJECTS OF THE INVENTION

It is an object of the invention to provide an inkjet recording element wherein the top layer after fusing is transformed into a protective layer that is both water-resistant and stain-resistant. It is another object of this invention to provide a porous top layer of an inkjet recording element that has good mechanical integrity, abrasion resistance, and after printing, can be thermally fused to provide high density of the printed image.

In addition, it would be desirable to increase the viscosity of a coating composition for a porous fusible coating having a hydrophobic binder in order to improve coating properties. It would also be desirable for the layer formed from the coating composition to set or gel once coated onto a moving web. Achieving these objectives is a significant challenge. Typical viscosity modifiers and gelling agents, for example, gelatin or k-carrageenan, have been found to not only degrade the water resistance of the fused layer, but also render the fused protective layer susceptible to staining. It has been found that the presence of a thermosensitive polymer in a porous fusible coating, not only can enhance viscosity during coating, but also unexpectedly give water and stain resistant layers after fusing.

SUMMARY OF THE INVENTION

These and other objects are achieved in accordance with the invention which is related to an inkjet recording element comprising a support having thereon a porous fusible layer comprising fusible polymeric particles and a thermoresponsive polymer that is capable of exhibiting an LCST below 20° C. The binder in the porous fusible layer consists of greater than 90 percent by weight solids of one or more hydrophobic polymers, including the thermoresponsive polymer.

In one embodiment, a support having thereon in order (from the support, i.e. from lower to upper layers, not necessarily adjacent to each other or the support):

a) at least one porous ink-receiving layer; and b) a porous fusible top layer (for example, an ink-transporting layer) comprising fusible polymeric particles and a thermoresponsive polymer that exhibits an LCST below 20° C., in an amount of 1 to 20 percent by weight of solids, wherein the porous fusible layer comprises a total amount of polymeric binder, including the thermoresponsive polymer, that is entirely or substantially, based on percent by weight solids, comprised of one or more hydrophobic polymers.

The term "binder," is defined as a film-forming material that holds together the fusible polymeric particles. The term "hydrophobic," with respect to a binder, is defined as a polymer that is not soluble in water at a concentration that exceeds 1 g/liter of water at 25° C. Hydrophobic polymers, although not soluble, may be colloidally dispersed in water as is known in the art.

The thermoresponsive polymer acts as a binder for the fusible polymeric particles, is water soluble when applied in an aqueous coating solution according to the present method, and does not degrade the water and stain resistance of the print subsequent to fusing. The present porous inkjet recording element is obtained which has good abrasion resistance prior to fusing, and which when printed with an inkjet ink, and subsequently fused, has good water-resistance and stain resistance.

Another embodiment of the invention relates to an inkjet printing method comprising the steps of: A) providing an inkjet printer that is responsive to digital data signals; B) loading the inkjet printer with the inkjet recording element described above; C) loading the inkjet printer with an inkjet ink composition; D) printing on the herein-described inkjet recording element using the inkjet ink composition in response to the digital data signals; and E) fusing at least the porous fusible layer. In a preferred embodiment, only the porous fusible layer is fused. However, the printing method can further comprise simultaneously fusing an underlying porous ink-fluid receiving layer in addition to a porous fusible porous topmost layer, such that both layers become non-porous.

Another aspect of the present invention relates to a method of manufacturing the above-described inkjet recording element, the method comprising:

(a) providing a coating composition comprising an aqueous dispersion of fusible polymer particles and a thermoresponsive polymer having an LCST below 20° C. in an amount of 1 to 20 percent by weight of solids, wherein the total amount of polymeric binder, including the thermoresponsive polymer, is made up entirely or substantially of one or more hydrophobic polymers, based on percent by weight solids;

(b) applying the coating composition over a substrate, the substrate comprising a support and optionally one or more ink-receiving layers, wherein the coating composition is at a temperature of at least 5° C. below the LCST of the thermoresponsive polymer, to form a coated layer; and (c) drying the coated layer above the LCST, at a temperature of at least 20° C., but below the fusing temperature of the fusible polymeric particles.

As used herein, the term "porous layer" is used to define a layer that absorbs applied ink substantially by means of capillary action rather than liquid diffusion. (Similarly, the term porous element refers to an element having at least one porous layer.) Porosity can be affected by the particle to binder ratio. The porosity of a layer may be predicted based on the critical pigment volume concentration (CPVC).

As used herein, the terms "over," "above," "upper," "under," "below," "lower," and the like, with respect to layers in the inkjet media, refer to the order of the layers over the support, but do not necessarily indicate that the layers are immediately adjacent or that there are no intermediate layers.

In regard to the present method, the term "image-receiving layer" is intended to define one or more adjacent layers that are used substantially as a pigment-trapping layer, dye-trapping layer, or dye-and-pigment-trapping layer that is where the image formed by colorant substantially resides.

The term "ink-receiving layer" includes all layers that are receptive to an applied ink composition, that absorb or trap any part of the one or more ink compositions, or components thereof, used to form the image in the inkjet recording element, including the ink-carrier fluid and/or the colorant, which may include pigment-based or dye-based colorants. An ink-receiving layer, therefore, can include either an image-receiving layer, in which the image is formed by a dye and/or pigment, or an ink-carrier-liquid receptive layer in which the carrier liquid in the ink composition is absorbed upon application, although later removed by drying. Typically, all layers above the support are ink-receptive, and the support may or may not be absorbent.

The term "thermoplastic polymer" is used herein to define the polymer that flows upon application of heat, typically prior to any extensive crosslinking.

BRIEF DESCRIPTION OF THE DRAWINGS

The above and other objects, features, and advantages of the present invention will become more apparent when taken in conjunction with the following description and drawings, wherein.

DETAILED DESCRIPTION OF THE INVENTION

Figure 1:
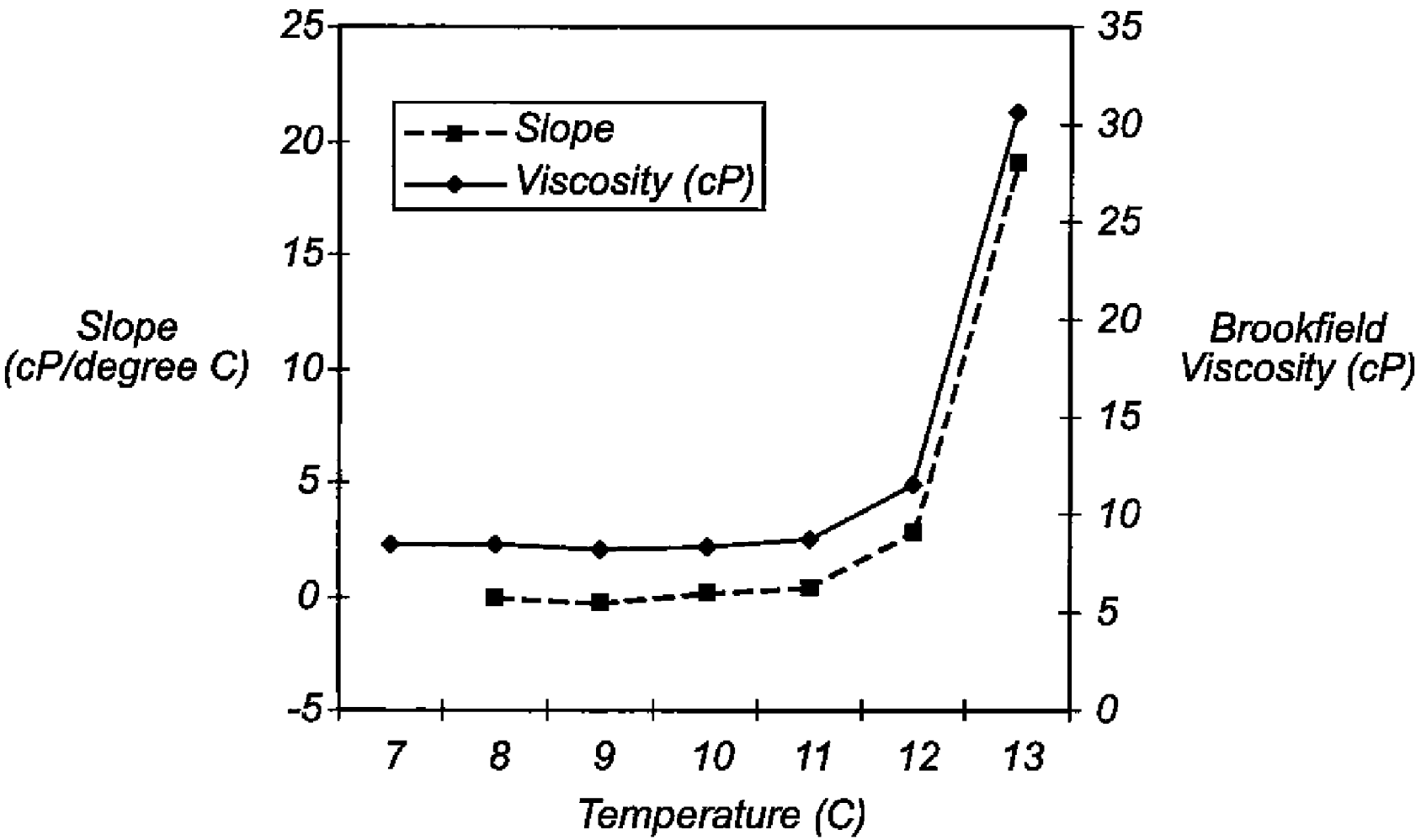
FIG. 1 shows the viscosity for a thermosensitive polymer, used in Examples of the present invention, plotted as a function of temperature.

As noted above, the inkjet recording element of the present invention comprises a support having thereon a porous fusible layer comprising fusible polymeric particles and a thermoresponsive polymer that is capable of exhibiting an LCST (Lower Critical Solution Temperature) below 20° C., wherein the total amount of polymeric binder in the porous fusible layer, including the thermoresponsive polymer, is hydrophobic or, based on percent by weight solids, substantially hydrophobic.

In the present method, for making the inkjet recording element of the present invention, the thermoresponsive polymer increases the viscosity of the coating composition for the porous fusible layer when applied at a temperature below the LCST. In one preferred embodiment, the polymer is used in an amount that would increase the zero shear viscosity of an aqueous solution at least 5 cP measured at 5 degrees below its LCST.

The thermoresponsive polymer, in the coating composition of the present invention, optionally may be used to form a gel when the temperature of the solution, after being coated, is raised above its LCST. However, gel formation will depend on a sufficient concentration of the thermoresponsive polymer in the coating composition. The formation of a gel is preferable, however, in order to improve drying efficiency.

The thermoresponsive polymer is characterized by being soluble (hydrophilic) in cold water but insoluble and hydrophobic and optionally gel forming when warmed. The temperature at which the soluble to insoluble transition occurs is called the lower critical solution temperature, also referred to in technical literature as various other terms such as the thermosensitive temperature.

In the literature, and as used herein, the "Lower Critical Solution Temperature" for a polymer is determined from plots of optical density at 600 nm versus temperature for 0.03% solution of the polymer in PBS (phosphate buffered saline) and is defined as the temperature at which $A_{600}$ is 0.1, wherein $A_{600}$ is the absorption at 600 nm. Temperatures are raised at less than 0.3° C. per minute and are measured with a thermometer. See *Reversible Polymeric Gels and Related Systems*, Paul S. Russo, Editor, ACS Symposium Series 350 (American Chemical Society, Washington, D.C. 1987), Chapter 18, pages 255-264, hereby incorporated by reference. Similar determinations can be made from cloud points of 0.1% solutions. In the Examples, the LCST of a polymer was estimated, using a 3% aqueous solution of the polymer, by plotting viscosity as a function of temperature using a Brookfield viscometer with attached spindle no. 18 at 50 rpm (shear rate). The temperature at which the rate of viscosity increase first reaches 10 cps/° C. is taken as an estimate of the LCST. Thus, the thermosensitive temperature can be confirmed by abrupt change in the viscosity or transparency of the thermoresponsive polymer at the thermosensitive temperature.

A thermosensitive polymer, which reversibly exhibits hydrophilicity or water-solubility at a certain temperature or less and exhibits hydrophobicity at a temperature higher than the LCST, can be a homopolymer or copolymer of thermosensitive monomers known in the art. Monomers that are known to exhibit thermosensitivity when the monomer is homopolymerized include, but are not limited to, N-alkyl or N-alkylene(meth)acrylamide derivatives (here "(meth)acryl" means "methacryl and acryl"), vinyl methyl ether, polyethyleneglycol(meth)acrylate derivatives, and the like. In the present invention, it is particularly preferred to use the N-alkyl or N-alkylene(meth)acrylamide derivatives.

Examples of the N-alkyl or N-alkylene(meth)acrylamide derivatives may include N-t-butyl(meth)acrylamide, N-ethyl (meth)acrylamide, N-isopropyl(meth)acrylamide, N-cyclopropyl(meth)acrylamide, N,N-diethylacrylamide, N,N-dimethyl(meth)acrylamide, N-n-propyl(meth)acrylamide, N-methyl-N-n-propylacrylamide, N-methyl-N-isopropylacrylamide, N-(meth)acryloylpyrrolidine, N-(meth)acryloylpiperidine, N-tetrahydrofurfuryl(meth)acrylamide, N-methoxypropyl(meth)acrylamide, N-ethoxypropyl(meth) acrylamide, N-isopropoxypropyl(meth)acrylamide, N-ethoxyethyl(meth)acrylamide, N-(2,2-dimethoxyethyl)-N-methylacrylamide, N-methoxyethyl(meth)acrylamide, N-(meth)acryloylmorpholine, etc. The monomers N-isopropylacrylamide, N-n-propylacrylamide, N-t-butylacyramide, and N,N-diethylacrylamide are particularly preferred and are commercially available.

In one preferred embodiment of the invention, the thermoresponsive polymer is a poly(N-alkylacrylamide), more particularly, an acrylamide copolymer prepared from at least two different N-alkylacrylamide monomers wherein each alkyl group has from 2 to 6 carbon atoms.

Copolymerizable monomers include non-ionic vinyl monomers, both lipophilic vinyl monomers and hydrophilic vinyl monomers. Examples of lipophilic vinyl monomers include (meth)acrylates such as methyl(meth)acrylate, n-butyl(meth)acrylate, 2-ethylhexyl(meth)acrylate, etc., styrene, ethylene, vinyl acetate and the like. Examples of hydrophilic vinyl monomers include (meth)acrylates such as 2-hydroxypropyl(meth)acrylate, etc., acrylamides such as (meth)acrylamide, N-methyl(meth)acrylamide, N-vinyl-2-pyrrolidone, etc., which do not show thermosensitivity when they are homopolymerized.

Also, a monomer having a carbonyl group may be used as a monomer to be copolymerized. In particular, when a thermoresponsive polymer using a monomer containing a carbonyl group, a cross-linking agent having at least two hydrazine groups or semicarbazide groups can be added to the coating solution, thereby adding to the strength and water-resistance of the resulting layer. Specific examples of comonomers having a carbonyl group include acrolein, diacetone acrylamide, diacetone methacrylate, etc. The hydrazine type cross-linking agent is, for example, a product obtained by the reaction of adipic hydrazide or a polyisocyanate compound with hydrazine. Other commercially available hydrazine type cross-linking agents may also be utilized.

The thermoresponsive polymer may be made using an emulsion polymerization technique or a solution polymerization technique, preferably the latter.

In the thermoresponsive polymer used in the present invention, it is possible to control the LCST by selecting the kind/nature and proportion of each monomer component that provides thermosensitivity and each optional comonomer component that does not. The monomer component that provides thermosensitivity at the LCST is preferably present, in the total monomer composition, in an amount of 50% by weight or less, more preferably 30% by weight or less.

The thermosensitive temperature of the thermoresponsive polymer according to the present invention is below 20° C., preferably in the range of 1 to 15° C., and more preferably at least 5° C.

The above-described inkjet recording element can be manufactured by a method comprising:

(a) providing a coating composition comprising an aqueous dispersion of fusible polymer particles and a thermoresponsive polymer that exhibits an LCST below 20° C.; and (b) applying the coating composition over a substrate at a temperature of at least 5° C. below the LCST of the thermoresponsive polymer and then drying at a temperature of at least 20° C. but below the fusing temperature of the fusible polymeric particles.

When the thermoresponsive polymer used in the present invention is added to the coating solution, the time of addition may be at any time so long as it is before coating. It is preferably added to the coating solution as a powder at a temperature not lower than the LCST. The coating solution is then chilled to a temperature lower than the LCST of the polymer so that the polymer is dissolved in the coating composition. In its hydrophilic state, the dissolved polymer viscosifies the coating solution.

In the present method, the chilled coating solution, maintained below the LCST of the polymer, is coated onto a substrate. The substrate itself may be optionally chilled, for example, in a chilling zone before or after, or both before and after the point where the solution is coated onto the substrate. Maintaining the coating solution below its LCST allows for flow and spreading of the coating solution on the support.

Optionally, it may be desirable to simultaneously coat the porous fusible layer and underlying ink-retaining layers. Alternatively, sequential coating may be employed.

Typically, a drying zone of sufficient length to remove coating solvent to achieve the desired degree of dryness employs heated air impinging on the surface(s) of the coating. When the coating solution reaches a temperature higher than the LCST of the thermoresponsive polymer, preferably a temperature 5° C. or more higher than the LCST, the polymer becomes hydrophobic. It is also possible that when the temperature of the coating solution rises above the LCST, the transition of the polymer from hydrophilic to hydrophobic character may gel the coated solution.

The content of the thermoresponsive polymer used in the present invention is in the range of 1 to 20% by weight, preferably in the range of 2 to 10% by weight based on the solids content of the coating composition. The thermoresponsive polymer increases the viscosity of the coating composition when the coating solution is at low temperature. By using the thermoresponsive polymer in the above-mentioned range, the viscosity change of the coated solution is reversible.

The fusible polymeric particles employed in the invention are derived from a thermoplastic polymer. The fusible polymeric particles may have any particle size provided they will form a porous layer. In a preferred embodiment, the particle size of the fusible polymeric particles may range from about 0.1 to 10 μm, preferably 0.5 to 5 μm.

The fusible polymer particles are preferably substantially spherical in shape. Monodisperse particles may be advantageous for controlling fluid absorption and can be used to improve dry time. On the other hand, monodispersed particles may be more difficult to make. The UPA monodispersity ("Dp"), which is defined as the weight average particle size divided by the number average particle size of the polymers in the bead, is preferably less than 2.0, as measured by a MICROTRAC Ultra Fine Particle Analyzer (Leeds and Northrup) at a 50% median value. This is another way of saying that the particle size distribution is relatively narrow which, in combination with the particle (or "bead") size, promotes capillary action.

Upon fusing of the fusible polymeric particles, the air-particle interfaces present in the original porous structure of the upper fusible layer are eliminated, and a non-light-scattering, substantially continuous layer forms. The fused layer then serves as a non-light-scattering protective overcoat, which protects the bulk of the image from abrasions and affords high optical densities.

The fusible polymeric particles comprising the upper fusible layer may be formed, for example, from an acrylic polymer, a styrenic polymer, a vinyl polymer, an ethylene-vinyl chloride copolymer, a polyacrylate, poly(vinyl acetate), poly (vinylidene chloride), or a vinyl acetate-vinyl chloride copolymer. In a preferred embodiment of the invention, the fusible polymeric particles comprise an acrylic polymer, a cellulose acetate ester, or a polyurethane polymer. In one particularly preferred embodiment of the invention, the fusible polymeric particles are made from polyurethane.

The porous fusible layer is usually present in an amount from about 1 $g/m^2$ to about 50 $g/m^2$. In a preferred embodiment, the porous fusible layer, in combination with one or more underlying ink-retaining layers, is present in an amount from about 1 $g/m^2$ to about 10 $g/m^2$.

The porous fusible layer may optionally comprise one or more additional hydrophobic film-forming polymers, in the binder, in addition to the thermoresponsive polymer. Alternatively the thermoresponsive polymer may be the only binder material. Preferred additional hydrophobic binders include, but are not limited to, polyurethane, styrene-butadiene, or acrylic polymers. The film-forming, hydrophobic binder useful in the invention can be any film-forming hydrophobic polymer capable of being dispersed in water. In a preferred embodiment of the invention, the hydrophobic binder is an aqueous dispersion of an acrylic polymer or polyurethane.

The fusible layer does not contain a substantial amount of hydrophilic binder, preferably none. More than 90% by weight, more preferably more than 95% by weight of the total binder, most preferably essentially all of the binder (including the thermosensitive polymer), in the porous fusible layer is hydrophobic. As mentioned above, a binder is hydrophobic if it is a polymer than is not soluble in water at a concentration exceeding 1 g/liter of water at 25° C.

The particle-to-binder ratio of the particles and binder employed in the porous fusible layer can range between about 98:2 and 60:40, preferably between about 95:5 and 80:20. In general, a layer having particle-to-binder ratios above the range stated will usually not have sufficient cohesive strength; and a layer having particle-to-binder ratios below the range stated will usually not be sufficiently porous to provide good image quality.

In a preferred embodiment, the element of the invention comprises, under the porous fusible layer, at least one underlying porous ink-receiving layer. The lower porous ink-receiving layer can be any porous structure. It may be comprised of refractory inorganic materials or fusible thermally compliant materials, or mixtures thereof. The ink-receiving layer may optionally contain mordant. It is preferred that the mean pore radius in the lower ink-receiving layer is smaller than that of the porous fusible layer. Thus, if the ink-receiving layer is composed of particles and binder, the particles will be significantly smaller than the fusible polymeric particles in the top porous fusible layer, thereby assuring a preferred pore-size hierarchy. The preferred pore-size hierarchy assures that the ink is withdrawn from the large capillaries of the topmost porous fusible layer and retained in the smaller capillaries of the ink-receiving layer.

In general, the ink-receiving layer or layers, in total, will have a thickness of about 1 μm to about 50 μm, and the topmost fusible porous layer will usually have a thickness of about 2 μm to about 50 μm. In a preferred embodiment, the ink-receiving layer is present in an amount from about 1 $g/m^2$ to about 50 $g/m^2$, preferably from about 5.0 $g/m^2$ to about 30 $g/m^2$.

In a preferred embodiment of the invention, the ink-receiving layer is a continuous, co-extensive porous layer that contains organic or inorganic particles. Examples of organic particles which may be used include core/shell particles such as those disclosed in U.S. Pat. No. 6,492,006 of Kapusniak et al. and homogeneous particles such as those disclosed in U.S. Pat. No. 6,475,602 of Kapusniak et al., the disclosures of which are hereby incorporated by reference. Examples of organic particles which may be used include acrylic resins, styrenic resins, cellulose derivatives, polyvinyl resins, ethylene-allyl copolymers and polycondensation polymers such as polyesters. Examples of inorganic particles which may be used in the ink-receiving layer of the invention include silica, alumina, titanium dioxide, clay, calcium carbonate, barium sulfate, and zinc oxide.

In a preferred embodiment of the invention, the porous ink-receiving layer comprises from about 20% to about 100% of particles and from about 0% to about 80% of a polymeric binder, preferably from about 80% to about 95% of particles and from about 20% to about 5% of a polymeric binder. The polymeric binder may be a hydrophilic polymer such as poly (vinyl alcohol), poly(vinyl pyrrolidone), gelatin, cellulose ethers, poly(oxazolines), poly(vinylacetamides), partially hydrolyzed poly(vinyl acetate/vinyl alcohol), poly(acrylic acid), poly(acrylamide), poly(alkylene oxide), sulfonated or phosphated polyesters and polystyrenes, casein, zein, albumin, chitin, chitosan, dextran, pectin, collagen derivatives, collodian, agar-agar, arrowroot, guar, carrageenan, tragacanth, xanthan, rhamsan and the like. Preferably, the hydrophilic polymer is poly(vinyl alcohol), hydroxypropyl cellulose, hydroxypropyl methyl cellulose, a poly(alkylene oxide), poly(vinyl pyrrolidinone), and poly(vinyl acetate) or copolymers thereof or gelatin.

In order to impart mechanical durability to an inkjet recording element, crosslinkers which act upon the binder discussed above may be added in small quantities. Such an additive improves the cohesive strength of the layer. Crosslinkers such as carbodiimides, polyfunctional aziridines, aldehydes, isocyanates, epoxides, polyvalent metal cations, vinyl sulfones, pyridinium, pyridylium dication ether, methoxyalkyl melamines, triazines, dioxane derivatives, chrom alum, zirconium sulfate and the like may be used. Preferably, the crosslinker is an aldehyde, an acetal or a ketal, such as 2,3-dihydroxy-1,4-dioxane.

The porous ink-receiving layer can also comprise an open-pore polyolefin, an open-pore polyester, or an open-pore membrane. An open-pore membrane can be formed in accordance with the known technique of phase inversion. Examples of a porous ink-receiving layer comprising an open-pore membrane are disclosed in U.S. Pat. No. 6,497,941 and U.S. Pat. No. 6,503,607, both by Landry-Coltrain et al.

Optionally, then a dye mordant may be employed in the underlying porous ink-receiving layer. The dye mordant can be any material that is substantive to inkjet dyes. The dye mordant can fix dyes within the porous ink-receiving layer, under the porous fusible layer. Examples of such mordants include cationic lattices such as disclosed in U.S. Pat. No. 6,297,296 and references cited therein, cationic polymers such as disclosed in U.S. Pat. No. 5,342,688, and multivalent ions as disclosed in U.S. Pat. No. 5,916,673, the disclosures of which are hereby incorporated by reference. Examples of these mordants include polymeric quaternary ammonium compounds, or basic polymers, such as poly(dimethylaminoethyl)-methacrylate, polyalkylenepolyamines, and products of the condensation thereof with dicyanodiamide, amine-epichlorohydrin polycondensates. Further, lecithins and phospholipid compounds can also be used. Specific examples of such mordants include the following: vinylbenzyl trimethyl ammonium chloride/ethylene glycol dimethacrylate;

poly(diallyl dimethyl ammonium chloride); poly(2-N,N,N-trimethylammonium)ethyl methacrylate methosulfate; poly (3-N,N,N-trimethyl-ammonium)propyl methacrylate chloride; a copolymer of vinylpyrrolidinone and vinyl(N-methylimidazolium chloride; and hydroxyethylcellulose derivatized with 3-N,N,N-trimethylammonium)propyl chloride. In a preferred embodiment, the cationic mordant is a quaternary ammonium compound.

In order to be compatible with the mordant, the binder and the particles in the porous ink-receiving layer should be either uncharged or the same charge as the mordant. However, colloidal instability and unwanted aggregation during coating should be avoided if the polymer particles or the binder has a charge opposite from that of the mordant.

In another preferred embodiment of the invention, two porous ink-receiving layers are present. In this embodiment, the uppermost layer is substantially the same as the lower layer, but at a thickness of only 1% to 20% of the thickness of the lower layer, and also contains from about 1-20% by weight of a mordant, such as a cationic latex mordant.

The two porous ink-receiving layers can be coated simultaneously or sequentially by any of the known coating techniques as noted below. The dye image is then concentrated at the thin uppermost ink-receiving layer containing a mordant, and thereby enhances print density.

The thickness of the underlying ink-receiving layer will depend on whether there are additional ink-fluid-receiving layers and/or an underlying support that is porous and capable of absorbing or contributing to the absorption of the liquid carrier. Preferably, the total absorbent capacity of (i) the ink receiving layer alone or (ii) if porous, the support alone or (iii) the combination of the ink receiving layer and, if porous, the support is, in each case, preferably at least about 10 cc/$m^2$, although the desired absorbent capacity is related to the amount of fluid applied which amount may vary depending on the printer and the ink composition employed. By a total absorbent capability of at least 10.0 cc/$m^2$ is meant that the capacity is such as to enable at least 10.0 cc of ink to be absorbed per 1 $m^2$. This is a calculated number, based on the thickness of the layer or layers. In the case of voided layers, the desired thickness can be determined by using the formula $t=10.0/v$ where v is the void volume fraction defined as the ratio of voided thickness minus unvoided thickness to the voided thickness.

The support used in the inkjet recording element of the invention may be opaque, translucent, or transparent. The support may itself be porous or non-porous. There may be used, for example, plain papers, resin-coated papers, various plastics including a polyester resin such as poly(ethylene terephthalate), poly(ethylene naphthalate) and poly(ester diacetate), a polycarbonate resin, a fluorine resin such as poly(tetra-fluoro ethylene), metal foil, vinyl, fabric, laminated or coextruded supports, various glass materials, open-pore polyolefins, open-pore polyester, and the like. In a preferred embodiment, the support is a resin-coated paper. The thickness of the support employed in the invention can be from about 12 to about 500 μm, preferably from about 75 to about 300 μm.

If desired, in order to improve the adhesion of an ink-receiving layer to the support, the surface of the support may be corona-discharge-treated prior to applying the ink-receiving layer or solvent-absorbing layer to the support.

Since the inkjet recording element may come in contact with other inkjet recording articles or the drive or transport mechanisms of image recording devices, additives such as surfactants, lubricants, UV-absorbing agents, matte particles and the like may be added to the element to the extent that they do not degrade the properties of interest.

The layers described above, including the ink-receiving layer and the porous fusible layer, may be coated by conventional coating means onto a support material commonly used in this art. Coating methods may include, but are not limited to, wound wire rod coating, slot coating, slide hopper coating, gravure, curtain coating, and the like. Some of these methods allow for simultaneous coatings of both layers, which is preferred from a manufacturing economic perspective.

After printing on the element of the invention, the porous fusible layer is heat and/or pressure fused to form a substantially continuous layer on the surface. Upon fusing, the layer is rendered non-light-scattering. Fusing may be accomplished in any manner that is effective for the intended purpose. In a preferred embodiment, fusing is accomplished by contacting the surface of the element with a heat-fusing member, such as a fusing roller or fusing belt. A description of a fusing method employing a fusing belt can be found in U.S. Pat. No. 5,258,256, and a description of a fusing method employing a fusing roller can be found in U.S. Pat. No. 4,913,991, the disclosures of which are hereby incorporated by reference. Fusing can be accomplished, for example, by passing the element through a pair of heated rollers, heated to a temperature of about 60° C. to about 160° C., using a pressure of about 70 to about 700 kPa transport rate of about 0.005 m/sec to about 0.5 m/sec.

Inkjet inks used to image the recording elements of the present invention are well known in the art. The ink compositions used in inkjet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

The present invention is explained in more detail by referring to the following Examples, but the present invention is not limited by these Examples. Incidentally, all "part(s)" and "%" refer to "part(s) by weight" and "% by weight" unless otherwise indicated.

EXAMPLES

Synthesis of the LCST Polymer

P-1, an LCST Polymer, namely poly(N-t-butylacrylamide-co-N-isopropylacrylamide) (40/60 moles), was prepared as follows. A 500 ml three-necked round-bottomed flask fitted with a mechanical stirrer, reflux condenser, and nitrogen inlet tube was charged with a solution of 21.4 g of N-t-butylacrylamide and 28.6 g of N-isopropylacrylamide in 225 ml of tetrahydrofuran. The solution was sparged with nitrogen gas for 30 min, after which 0.25 g of 2,2'-azobisisobutyronitrile was added. The solution was stirred in a constant-temperature bath at 60° C. under a slight positive pressure of nitrogen for 24 hours.

The slightly hazy reaction mixture was cooled, and precipitated slowly into 3 L of water with efficient stirring. The solid polymer was isolated by filtration, washed well with fresh water, and dried in a vacuum. The powdery product was re-dissolved in tetrahydrofuran, re-precipitated into water as above, filtered, washed and dried in a vacuum, first at room temperature and finally at 50° C. for 2 days.

The copolymer had a glass transition temperature (Tg) of 136.0° C. (midpoint) as determined by differential scanning calorimetry. Size-exclusion chromatography (poly(ethylene glycol) equivalents) produced a number-average molecular weight of 5120 and a weight-average molecular weight of 14,000. The LCST of the polymer was 14° C.

A 3% aqueous solution of the polymer P-1 was prepared at 5° C. The viscosity was measured in a Brookfield Viscometer with spindle #18 at 50 rpm. Viscosity was recorded as a function of temperature from 7° C. to 14° C. The results are plotted in FIG. 1.

The viscosity of the solution at 9° C., that is, at 5° below the LCST of the polymer P-1, is about 8 cP, which is 7 cP above the viscosity of water without the polymer. At the LCST of polymer P-1 (14°), the solution formed a gel and the viscosity could not be measured. The LCST can be estimated from FIG. 1, which is consistent with the determination from plots of optical density at 600 nm versus temperature for 0.03% solution of the polymer in PBS (phosphate buffered saline), wherein LCST is defined as the temperature at which $A_{600}$ is 0.1 and $A_{600}$ is the absorption at 600 nm.

Comparative Polymers

Control polymers that are viscosity-increasing and gelling polymers are generally soluble in warm water and set to give hydrophilic gels on cooling. They differ from the thermoresponsive polymers in that even after the sol-to-gel transition the polymer gel remains hydrophilic. The following control polymers were used.

CP-1: Limed Ossein Gelatin

CP-2: Kappa-Carrageenan, type 1

Synthesis of Polyurethane Thermoplastic Polymer for Use in Making Fusible Thermoplastic Polymeric Particles To 600 g of ethyl acetate was added 26 g (0.194 mole) 2,2-bis(hydroxymethyl)propionic acid, 191.6 g (1.81 mole) diethyleneglycol, and 1.66 g of stannous octoate (catalyst). The temperature was adjusted to 70° C. and the contents stirred for about 30 minutes at which time the solution became clear. While stirring, 444.8 g (2 moles) of isophorone diisocyanate and 40 g ethyl acetate were slowly added dropwise. The temperature was raised to 75° C. and the reaction stirred at temperature until completion. Evaporation of the solvents afforded 662 g polyurethane.

Preparation of Fusible Thermoplastic Polymeric Particles

To a stirred solution of 186.3 g of the above-prepared polyurethane dissolved in 341.5 g of ethyl acetate was added 6.2 g of triethanolamine. This organic phase was then heated to 68° C. A separate aqueous composition was prepared by mixing 22.5 g of ethyl acetate and 1150 g of deionized water followed by heating to 68° C. The aqueous phase was added slowly to the organic phase while stirring using a low shear propeller-mixing device. The resulting oil-in-water emulsion was then passed once through a GAULLIN colloid mill with a gap setting of 0.04 inches and collected in a round bottom flask. The ethyl acetate was removed from the homogenized sample by rotary evaporation for one hour under vacuum at 68° C. and the particles were concentrated to afford a 48% solids dispersion having a mean particle diameter of 1.0 μm.

Preparation of Coating Particle Slurry S-1 for Fusible Porous Upper Layer

To 10.0 g of the above stirred polyurethane particle dispersion (48% solids) was added 2.0 g of deionized water, and 0.08 g of SILWET 7602. To the stirred room temperature slurry was then added 0.25 g thermoresponsive polymer, P-1 as prepared above. The mixture was stirred continuously for twenty minutes to make a uniform dispersion. The slurry was then cooled in an ice bath to 5° C., below the LSCT, to dissolve the P-1 polymer. An increase in viscosity was noted. The viscosified slurry was allowed to warm to room temperature, above the LSCT, and was observed to set to gel. On re-chilling to 5° C. it reformed a coatable viscosified slurry.

Preparation of Coating Particle Slurry S-2 for Fusible Porous Upper Layer

To 10.0 g of the above stirred polyurethane particle dispersion (48% solids) was added 2.0 g of deionized water, and 0.08 g of SILWET 7602. To the stirred room temperature slurry was then added 0.25 g thermoresponsive polymer, P-1, as prepared above. The mixture was stirred continuously for 20 minutes. The slurry was then cooled in an ice bath to 5° C., below the LSCT, to dissolve the P-1 polymer. An increase in viscosity was noted. The viscosified slurry was observed to set to a gel on warming to room temperature, above the LCST. On re-chilling to 5° C. it reformed a coatable viscosified slurry to which was added 1.6 g of the hydrophobic binder WITCOBOND W320, a 35% aqueous dispersion of 1.9 micron polyurethane particles with a Tg=−12° C. The slurry was allowed to warm to room temperature and was again observed to set to a gel. On re-chilling to 5° C. it reformed a coatable viscosified slurry.

Preparation of Control Coating Particle Slurry, S-3

To 3.75 g of the above stirred polyurethane particle dispersion (48% solids) was added 0.6 g of the hydrophobic binder WITCOBOND W320, a 35% aqueous dispersion of 1.9 micrometer polyurethane particles with a Tg=−12° C. The stirred slurry was warmed to 50° C. and then 4.8 g of a 5% solution of the control viscosity-increasing and gelling agent, CP-1, limed ossein gelatin at 50° C. was added, and sufficient deionized water to give a total coating weight of 10.0 g. The slurry set on cooling to 5° C., and was rewarmed to 50° C. to give a viscosified coating slurry.

Preparation of Control Coating Particle Slurry, S-4

To 10.0 g of the above stirred polyurethane particle dispersion (48% solids) was added 6.0 g of deionized water and 0.20 g of viscosity-increasing and gelling agent, CP-2, Carrageenan, type 1. The stirred slurry was warmed to 60° C. to give viscosified coating slurry.

Preparation of Porous Ink-Receiving Layers

A polyethylene resin-coated paper support was corona discharge treated. The support was then hopper coated and force air dried at 60° C. to provide the following ink-receiving layers which were simultaneously coated:

Lower Ink-Receiving Layer L1—a 38-μm layer comprising 87% fumed alumina, 9% poly(vinyl alcohol), and 4% dihydroxydioxane crosslinking agent Upper Ink-Receiving Layer L2—a 2-μm layer comprising 85% fumed alumina, 8% 100 nm colloidal latex dispersion of poly(divinylbenzene-co-N-vinylbenzyl-N,N,N-trimethylammonium chloride), 6% poly(vinyl alcohol), and 1% ZONYL FSN surfactant (DuPont Corp.).

Elements of the Invention, E-1 and E-2

The particle slurries S-1 and S-2 were chilled to a temperature between about 5 and 10° C. The topmost porous fusible layer was prepared by separately coating these particle slurries, S-1 and S-2, as shown in Table 1 below, over a substrate (consisting of the support coated with the porous ink-receiving layers as prepared above) using a 40 mm wire wound rod, to give Elements 1 and 2 of the invention. During the coating operation, the substrate was held on top of a chilled coating block with a vacuum platen, to maintain the coating solution below the LSCT. The coated substrate was then removed from the chilled coating block and allowed to dry at room temperature.

Control Elements C-1 and C-2

The controls, C-1 and C-2, were prepared in the same manner as the Elements of the invention except using the control particle slurries, S-3 and S-4, as shown in Table 1 below.

Printing

A test target was printed with a Hewlett-Packard PHOTOSMART printer. The target comprised fourteen 1-$cm^2$ color patches, a 100% and a 50% density patch in each of the three primary, three secondary colors, and black. Additionally, five 1-$cm^2$ unprinted areas were outlined for stain testing as described below.

Fusing

The printed elements and control samples were fused in a heated nip at 150° C. and 410 kPa against a sol-gel coated polyimide belt at 0.0128 m/sec.

Water Resistance

A water drop was placed on each color patch of the fused print for 30 minutes and then blotted. Waterfastness was judged by the transfer of dye to the blotter and density loss in the blotted color patch on the following scale:

3—No dye transfer to blotter and no density loss observable in blotted color patches.

2—Observable level of dye transfer to blotter and observable density loss in the blotted color patches.

1—Heavy dye transfer to blotter and significant density loss in the blotted color patch.

Stain Resistance

Samples of 100 mg each of common stains: coffee, fruit punch, cola drink, and mustard (coffee=C, fruit punch=F, cola=L, mustard=M) were placed on unprinted areas of fused elements and controls. After ten minutes the material was wiped away, first with a dry paper towel and then with a wet paper towel. Any residual stain was noted as follows:

3—No stain observable in test patch.

2—Observable stain in test patch.

1—Heavy stain in test patch.

TABLE 1

| Element | Coating Solution | Water Resistance | Stain Resistance |
|---|---|---|---|
| E-1 | S-1 | 3 | 3 |
| E-2 | S-2 | 3 | 3 |
| C1 | S-3 | 1 | 1 |
| C2 | S-4 | 2 | 2 |

The results show that Elements 1 and 2 of the invention have simultaneously good water resistance and stain resistance properties, whereas the control elements do not.

The invention claimed is:

1. An inkjet recording element comprising a support having thereon a porous fusible top layer comprising fusible polymeric particles and, in an amount of 1 to 20 percent by weight of solids, a thermoresponsive polymer having a lower critical solution temperature (LCST) below 20° C., wherein greater than 90 percent, by weight solids, of total polymeric binder in the layer, including at least the thermoresponsive polymer, consists of one or more hydrophobic polymers.

2. The element of claim 1 wherein the porous fusible layer comprises a hydrophobic polymer in addition to the thermoresponsive polymer.

3. The element of claim 2 wherein the hydrophobic polymer is a polyurethane, styrene-butadiene, or acrylic polymer.

4. The element of claim 1, further comprising, under the porous fusible top layer, at least one porous ink-receiving layer.

5. The element of claim 1 wherein the particle-to-binder ratio of the fusible porous layer is between about 95:5 and 60:40.

6. The element of claim 1 wherein the thermoresponsive polymer is a polyacrylamide.

7. The element according to claim 1, wherein the thermoresponsive polymer comprises an N-alkyl or N-alkylene (meth) acrylamide monomeric repeat unit.

8. The element of claim 7 wherein the thermoresponsive polymer is an acrylamide copolymer prepared from at least two different N-alkylacrylamide monomers wherein each alkyl group has from 2 to 6 carbon atoms.

9. The element according to claim 1, wherein the thermoresponsive polymer is a homopolymer or copolymer of at least one monomer selected from the group consisting of N-t-butyl(meth)acrylamide, N-ethyl(meth)acrylamide, N-isopropyl(meth)acrylamide, N-cyclopropyl(meth)acrylamide, N,N-diethylacrylamide, N,N-dimethyl(meth)acrylamide, N-n-propyl(meth)acrylamide, N-methyl-N-n-propylacrylamide, N-methyl-N-isopropylacrylamide, N-(meth) acryloylpyrrolidine, N-(meth)acryloylpiperidine, N-tetrahydrofurfuryl(meth)acrylamide, N-methoxypropyl (meth)acrylamide, N-ethoxypropyl(meth)acrylamide, N-isopropoxypropyl(meth)acrylamide, N-ethoxyethyl(meth)acrylamide, N-(2,2-dimethoxyethyl)-N-methylacrylamide, N-methoxyethyl(meth)acrylamide and N-(meth)acryloylmorpholine.

10. The element according to claim 9, wherein the thermoresponsive polymer is a homopolymer or copolymer of at least one monomer selected from the group consisting of N-t-butylacrylamide, N-isopropylacrylamide, N-n-propylacrylamide, N,N-diethylacrylamide and N-acryloylmorpholine.

11. The element of claim 4 wherein the at least one porous ink-receiving layer comprises from about 20% to about 100% of particles and from about 0% to about 80% of a polymeric binder.

12. The element of claim 11 wherein the particles of the porous ink-receiving layer are selected from the group consisting of silica, alumina, titanium dioxide, clay, calcium carbonate, barium sulfate, zinc oxide, and combinations thereof.

13. The element of claim 11 wherein the polymeric binder of the porous ink-receiving layer is selected from the group consisting of poly(vinyl alcohol), hydroxypropyl cellulose, hydroxypropyl methyl cellulose, a poly(alkylene oxide), poly (vinyl pyrrolidinone), poly(vinyl acetate), copolymers thereof, gelatin, and combinations thereof.

14. The element of claim 4 wherein the porous fusible top layer has a thickness of about 1 μm to about 25 μm and the ink-receiving layer has a thickness of about 2 μm to about 50 μm.

15. An inkjet recording element comprising a support having thereon in order from the support:

a) at least one porous ink-receiving layer; and b) a porous fusible topmost layer comprising fusible polymeric particles and a thermoresponsive polymer that exhibits a lower critical solution temperature (LCST) below 20° C. in an amount of 1 to 20 percent by weight of solids, wherein greater than 90 percent, by weight solids, of total polymeric binder in the layer, including at least the thermoresponsive polymer, consists of one or more hydrophobic polymers.

16. The inkjet recording element of claim 15 wherein the porous fusible topmost layer is an ink-transporting layer and the porous ink-receiving layer is an image-receiving layer.

17. A method of making an inkjet element comprising:

(a) providing a coating composition comprising an aqueous dispersion of fusible polymer particles and a thermoresponsive polymer having a lower critical solution temperature (LCST) below 20° C. in an amount of 1 to 20 percent by weight of solids, wherein greater than 90 percent, by weight solids, of total polymeric binder in the coating composition, including at least the thermoresponsive polymer, consists of one or more hydrophobic polymers;

(b) applying the coating composition over a substrate, the substrate comprising a support and optionally one or more ink-receiving layers, wherein the coating composition is at a temperature of at least 5° C. below the LCST of the thermoresponsive polymer, to form a coated layer; and (c) drying the coated layer above the LCST, at a temperature of at least 20° C., but below fusing temperature of the fusible polymeric particles.

18. The method of claim 17 wherein another coating composition for an ink-receiving layer is simultaneously coated with the coating composition.

19. The method of claim 17 wherein the thermoresponsive polymer is present in an amount sufficient to provide the coating composition with an increase in viscosity of at least 5 cP measured at 5 degrees below the LCST.

20. An inkjet printing method, comprising the steps of:

A. providing an inkjet printer that is responsive to digital data signals;

B. loading the printer with the inkjet recording element of claim 1;

C. loading the printer with an inkjet ink composition;

D. printing on the inkjet recording element using the inkjet ink composition in response to the digital data signals; and E. fusing at least the porous fusible top layer such that the layer becomes non-porous.

* * * * *